United States Patent [19]

Tsuneda

[11] 3,969,238

[45] July 13, 1976

[54] LIQUID DEVELOPER FOR ELECTROPHOTOGRAPHY AND PROCESS FOR DEVELOPING LATENT IMAGES

[75] Inventor: Terukuni Tsuneda, Matsudo, Japan

[73] Assignee: Canon Kabushiki Kaisha, Tokyo, Japan

[22] Filed: Aug. 10, 1973

[21] Appl. No.: 387,473

[30] Foreign Application Priority Data

Aug. 15, 1972 Japan ..... 47-81728
Aug. 15, 1972 Japan ..... 47-81729

[52] U.S. Cl. ..... 252/62.1 L; 260/29.6 SQ; 427/17

[51] Int. Cl.[2] ..... G03G 9/12; G03G 13/10

[58] Field of Search ..... 252/62.1; 427/15, 17; 260/29.6 SQ

[56] References Cited

UNITED STATES PATENTS

| | | | |
|---|---|---|---|
| 3,067,161 | 12/1962 | Roth | 260/29.6 SQ |
| 3,585,140 | 6/1971 | Machida et al. | 252/62.1 L |
| 3,639,244 | 2/1972 | Machida et al. | 252/62.1 L |
| 3,657,130 | 4/1972 | Machida et al. | 252/62.1 L |
| 3,788,995 | 1/1974 | Stahly et al. | 252/62.1 |
| 3,849,165 | 11/1974 | Stahly et al. | 427/15 |
| 3,874,896 | 4/1975 | Machida et al. | 252/62.1 |

*Primary Examiner*—Mayer Weinblatt
*Assistant Examiner*—John Douglas Smith
*Attorney, Agent, or Firm*—Fitzpatrick, Cella, Harper & Scinto

[57] ABSTRACT

A liquid developer for electrophotography and a process for developing latent images using the liquid developer. The liquid developer comprises a highly insulating carrier liquid, a toner particle dispersed therein, and a copolymer produced from at least one member selected from the monomers of the formula (1) and at least one member selected from the monomers of the formula (2) or a copolymer produced from at least one member selected from the monomers of the formula (1), at least one member selected from the monomers of the formula (2) and at least one member selected from the monomers of the formula (3).

General formula (1)

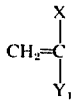

Where $X: -H, -CH_3$; $Y_1: -C_nH_{2n+1}, -OC_nH_{2n+1}, -COOC_nH_{2n+1}$ $(8 \leqq n \leqq 20)$ General formula (2)

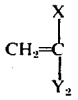

Where $X: -H, -CH_3$; $Y_2: -SO_3M_I, -CH_2SO_3M_I,$

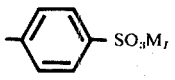

($M_I$ is alkali metal or $-NH_4$)

Or

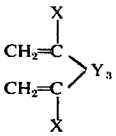

$X: -H, -CH_3$; $Y_3: -SO_3, -SO_3 > M_{II}, -CH_2SO_3, -CH_2SO_3 > M_{II}$

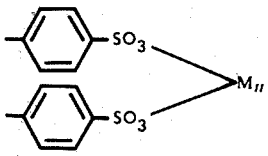

($M_{II}$ is alkaline earth metal).

General formula (3)

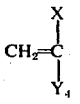

Where $X: -H, -CH_3$; $Y_4: -N < R_1, R_2$,

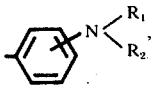

$-COO(CH_2)_n-N < R_1, R_2$ $-(CH_2)_n-N < R_1, R_2$

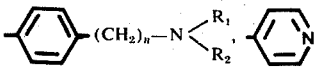

($1 \leqq n \leqq 4$, $R_1$, $R_2$ are H or $-C_mH_{2m+1}$ ($1 \leqq m \leqq 4$), and may the same or different)

14 Claims, No Drawings

LIQUID DEVELOPER FOR ELECTROPHOTOGRAPHY AND PROCESS FOR DEVELOPING LATENT IMAGES

BACKGROUND OF THE DISCLOSURE

1. Field of the Invention

The present invention relates to a liquid developer for use in developing electrostatic latent images in electrophotography, electrostatic printing etc.

2. Description of the Prior Art

The composition of the conventional liquid developer for electrophotography is such that the pigment particles and the additives such as resin etc which have such actions as to control the polarity of the pigment particles and give dispersibility in the carrier liquid or provide the fixability to a toner are dispersed in a highly insulating carrier liquid and in said carrier liquid the said pigment particles absorb the resins to form a toner. For instance, as a polarity controlling agent or a dispersing agent of the pigment particles such as carbon black, there are used vegetable oils such as linseed oil, soya bean oil and resins such as alkyl resin, polystyrene and acrylic resins, and these are mixed with the pigment to be kneaded and pulverized finely and then are dispersed in a carrier liquid e.g. a highly insulating organic solvent such as paraffin hydrocarbons to produce a liquid developer.

As a method for determining the polarity of the toner particle, in addition to a method in which the surface of the pigment particles is covered with a polarity controlling resin as described above, another method in which the charged condition is controlled by dissolving a surface active agent in a carrier liquid and causing it to be absorbed by the toner particle is known. The surface active agents used for such purpose are numerous and examples thereof are the metallic soaps such as cobalt naphthenate, manganese naphthenate and the alkyl benzene sulphonates such as calcium, sodium, barium and the like dodecylbenzene sulphonates and the phospholipids such as lecithin, cephalin, etc, but the method and effect of their use cannot be said to be always uniform, and because they are of low electric resistance when they are dissolved in a carrier liquid to use it to the degree at which although the electric resistance is lowered yet not to damage the electrostatic latent image which had been formed on the photosensitive body, the quantity of the surface active agent is subject to a strict limitation. Due to the above there is such a defect that sufficient quantity to give adequate electric charge to the toner particles cannot be added.

Also, those known materials which hitherto have been dissolved in a carrier liquid to impart a negative electric charge to the toner particles are not so numerous, and only lecithin, alkyl benzene calcium sulphonate, polyamide resin etc are known.

SUMMARY OF THE INVENTION

It is an object of the present invention to provide a liquid developer for electrophotography having negatively charged toner with no such defect as mentioned above.

It is another object of the present invention to provide a liquid developer for electrophotography wherein a negatively charging electric charge controlling agent which has a good solubility in a carrier liquid and does not lower the electric resistance of said carrier liquid is dissolved.

Still another object of the present invention is to provide a liquid developer for electrophotography which has a good storage stability and which provides a distinct and fogless image.

That is, the inventor of the present invention has made experiments relating to the effects of the electric charge control on the toner particles melting various polymers and copolymers in carrier liquids and found out that the below mentioned copolymers have strong effects on controlling the toner particles being charged negatively.

The present invention resides in a liquid developer for electrophotography characterized by being a liquid developer for electrophotography wherein toner particles are dispersed in a highly insulating carrier liquid and in the said carrier liquid is melted a copolymer comprising at least one kind of monomer selected from among the monomers shown by the below mentioned general formula (1) and at least one kind of monomer selected from among the monomers shown by the general formula (2) so as to cause the said toner particles to be charged negatively.

Further, the present invention resides in a liquid developer for electrophotography characterized by being a liquid developer for electrophotography wherein toner particles are dispersed in a highly insulating carrier liquid and in the said carrier liquid is melted a copolymer comprising at least one kind of monomer selected from among the monomers shown by the below mentioned general formula (1), at least one kind of monomer selected from among the monomers shown by the general formula (2) and at least one kind of monomer selected from among the monomers shown by the general formula (3) so as to cause the said toner particles to be charged negatively.

General formula (1)

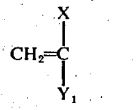

Where $\begin{cases} X: -H, -CH_3 \\ Y_1: -C_nH_{2n+1}, -OC_nH_{2n+1} \end{cases}$ $-COOC_nH_{2n+1}$
$(8 \leqq n \leqq 20)$ General formula (2)

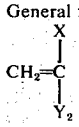

Where $\begin{cases} X: -H, -CH_3 \\ Y_2: -SO_3M_l, -CH_2SO_3M_l, \end{cases}$

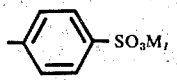

($M_l$ is alkali metal or $-NH_4$)

-continued or

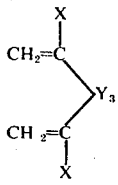

Where $\begin{cases} X: -H, -CH_3 \\ Y_3: -SO_3 \\ \quad -SO_3 \end{cases} > M_{II}$ $\quad -CH_2SO_3 \\ -CH_2SO_3 > M_{II}$

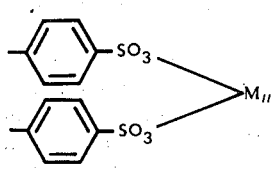

($M_{II}$ is alkaline earth metal)

General formula (3)

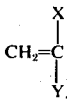

Where $\begin{cases} X: -H, -CH_3 \\ Y_4: -N < R_1, R_2 \end{cases}$, 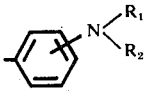 , $-COO(CH_2)_n-N < R_1, R_2$, $-(CH_2)_n-N < R_1, R_2$,

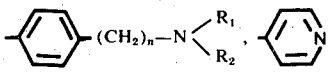

($1 \leqq n \leqq 4$, $R_1$, $R_2$ are H or $-C_mH_{2m+1}$ ($1 \leqq m \leqq 4$), and may be the same or different)

DESCRIPTION OF THE PREFERRED EMBODIMENTS

As the carrier liquid to be used in the present invention those which hitherto have been used for the electrophotography are usable, and use of the organic solvents having the volume resistance of $10^9$ Ω-cm or above and the dielectric constant of 3 or less is preferable.

For instance, paraffinic hydrocarbons, isoparaffinic hydrocarbons, alicyclic hydrocarbons, halogenated hydrocarbons, and the like, and specifically n-heptane, cyclohexane, dipentene, kerosene, mineral spirit, tetralin, perchloroethylene, trichlorotrifluoroethane and the like can be used.

Next, as the toner particles to be dispersed in the carrier liquid the finely pulverized pigment or kneaded mixture of adhesive resin and pigment is used.

As pigments such as Mogul A, Elftex 5, Elf Vulcan XC (trademarks for products of Cabot Corp.), Statex (trademark of a product of Columbia Carbon Co.), Carbon Black XC-550 (trademark of a product of Asahi Carbon Co.), Carbon Black No. 44, Carbon Black No. 100 (trademarks of products of Mitsubishi Kasei Co.), Benzidine Yellow GNN, Benzidine Orange Scarlet KR, Fast Red, Brilliant Carmine 6B, Sky Blue, Cyanine Blue FG, Phthalocyanine Green LL (trademarks of products of Sanyo Coloring Yatter Co.), Victoria Blue, Aizen Spilon Black, Aizen Spilon Orange, Aizen Spilon Red (trademarks of products of Hodogaya Kagaku Co.), Oil Blue, Vari Fast Blue, Spirit Black, Alkali Blue (trademarks of products of Orient Kasei Co.), Aniline Black (a product of ICI Co.), Cyanine Blue NSG, Farst Rose 836, Benzidine Yellow 471 (all of them are trademarks of products of Dainichi Seika Co.) etc. are used, but the pigments are used for the purpose of coloring the toner particles so that it is clear that all the pigments hitherto have been used for toner are usable.

And as the binder resins used mixing with the above mentioned coloring powders mainly for providing fixability, dispersibility and transcribability to the toner particles those resins which hitherto have been used for toners can also be used, and specifically use of the following resins is preferable. For instance such as polyvinyl chloride, polyvinylidene chloride, vinyl chloride-vinylidene chloride copolymer, chlorinated polypropylene, vinyl chloride-vinyl acetate copolymer, vinyl chloride-vinyl acetate-maleic anhydride copolymer, rubber hydrochloride, cyclized rubber, wax rubber, ethylcellulose, nitrocellulose, polyacrylic ester, linseed oil modified alkyd resin, polyvinyl acetate, polyamide resin, cumarone resin, dammar resin, colophonium modified phenol resin, ketone resin, maleic acid resin, polystyrene, low molecular polyethylene, colophonium, copal, ester, phenol modified pentaerythritol ester etc. are usable.

The copolymers which controls negatively the above mentioned toner particles used for the present invention are synthesized in a manner as described below.

That is, at least one member selected from the monomers of the afore-mentioned general formula (1) and at least one member selected from the monomers of the general formula (2), and, if necessary, at least one member selected from the monomers of the general formula (3) are subjected to solution polymerization or bulk polymerization in an atmosphere of nitrogen gas and in the presence of a polymerization initiator such as azoisobutyronitrile, benzoyl peroxide etc.

The specific examples of the monomers shown by the general formula (1) are such as vinyl laurate, vinyl oleate, vinyl stearate, dodecyl acrylate, octyl acrylate, stearyl acrylate, tridecyl acrylate, hexadecyl acrylate, dodecyl methacrylate, heptadecyl methacrylate, stearyl methacrylate, lauryl vinyl ether, n-octyl vinyl ether, tridecyl vinyl ether etc.

The specific examples of the monomers shown by the general formula (2) are such as sodium vinyl sulphonate, sodium allyl sulphonate, sodium methallyl sulphonate, sodium P-styrene sulphonate, calcium vinyl sulphonate, calcium allyl sulphonate, calcium methallyl sulphonate, calcium P-styrene sulphonate, barium P-styrene sulphonate, magnesium P-styrene sulphonate, strontium P-styrene sulphonate, potassium vinyl sulphonate, potassium allyl sulphonate, potassium methallyl sulphonate, potassium P-styrene sulphonate, ammonium vinyl sulphonate, ammonium allyl sulphonate, ammonium metallyl sulphonate, ammonium P-styrene sulphonate etc.

And the specific examples of the monomers shown by the general formula (3) are such as aminostyrene, allylamine, allyl methylamine, N-methylamino ethyl acrylate, N-ethylaminoethyl acrylate, N-methyl aminoethyl methacrylate, N-vinyl dimethyl amine, N,N-dimethylamino ethyl acrylate, N,N-diethyl aminoethyl acrylate, N,N-dimethylaminoethyl methacrylate, N,N-dimethylaminoethyl methacrylate, N-vinyl pyridine, 2-vinyl-5-methyl pyridine etc.

The copolymers obtained from the monomers of the above mentioned general formulae (1), (2) and (3) have the characteristics of good solubility in carrier liquids, excellency in the chemical stability and negatively control the toner particle electric charge. In the copolymer the monomer of the general formula (1) is considered to increase the solubility in carrier liquids, and when used with the number of atoms of carbon in the alkyl group being on the order of 8 – 20 it will show favorable solubility in the carrier liquid.

And the monomer of the general formula (2) is considered to affect on the control of electric charge and it has been found out that the copolymers consisting of the monomers of the general formulae (1) and (2) show good solubility in carrier liquids, and negatively control the electric charge of the toner particles. Further it has been found out that if the monomers of the general formulas (1) and (2) be combined with a monomer shown by the general formula (3) the resultant copolymer increases further the effect to control the toner particle electric charge negatively.

The ratio of monomers of the general formulas (1), (2) and (3) which constitute a copolymer can be changed variously in use depending on the monomers to be selected, nevertheless it is necessary that the monomer of the general formula (1) has to be contained in mole ratio of the degree not to reduce the solubility of the copolymer in a carrier liquid.

Also, even a small quantity of the monomer of the general formula (2) has an effect in controlling the electric charge of the toner particles negatively, and it may be increased to the extent that the solubility in a carrier liquid is not lost.

Furthermore, when the monomer of the general formula (3) is used, even a small quantity of the monomer of the general formula (2) shows a very strong controlling effect on the negative charge. A small quantity of the general formula (3) also shows a considerable effect and it can be used in the mole ratio of the degree not to reduce the solubility of the copolymer in a carrier liquid.

Next, the quantity to be added of the copolymer of the present invention is small and if a small quantity is dissolved in 1 *l* of carrier liquid it takes effect e.g. if added and melted 0.015 g or more it shows sufficient effect. Also, the property to reduce the electric resistance of the carrier liquid is low so that a fair amount of it can be melted in a carrier liquid in use, and can be used within the allowable range of the lowering of electric resistance of the carrier liquid without bringing about deterioration in the performance of liquid developer. However, the range of 0.015 g to 10 g per 1 *l* of carrier liquid is preferable as it is economical and causes no reduction in the electric resistance.

A description will be given below specifically with reference to the preferred embodiments of the present invention, however, these embodiments are for the purpose of aiding to understand the present invention and is not intended in any way to limit the present invention.

EXAMPLE 1

300 ml of dioxane, 42 g of stearyl methacrylate and 2.5 g of 2,2′-azobis (isobutyronitrile) were poured into a 4-neck 500 ml flask and after sufficiently replacing the air in the flask with nitrogen gas and while heating up to 40° – 50°C, a solution of 18 g of P-styrene sodium sulphonate in 50 ml of water was dropped and raised the liquid temperature up to 70° – 80°C, then after stirring for approximately 7 hours it was allowed to stand to cool down. Next the reaction liquid was concentrated under reduced pressure and refined twice by means of reprecipitation method using 20% hydrous methanol, and when the precipitates was dried, a light brown tacky material was obtained. When this material was analyzed by means of infrared absorption spectrum, it was confirmed that the material was a copolymer consisting of stearyl methacrylate and sodium p-styrene sulphonate.

Next, a mixture consisting of 60 g of carbon black, 150 g of wax rubber, 100 g of cumarone resin and 800 g of Isopar-H (trademark of a product of Esso Co.) was dispersed for 2 hours in a sand mill and 20 g of the resultanting dispersion and 0.9 g of the above mentioned copolymer were sufficiently dispersed in 800 g of Isopar-H and there was obtained a liquid developer.

On the other hand, on an alminium foil 0.05 mm thick was coated and dried a dispersion liquid consisting of 100 g of microcrystal cadmium sulfide, 10 g of 50% toluene solution of vinyl chloride-vinyl acetate copolymer and 80 g of toluene with the thickness of 40$\mu$ when dried.

On the top was sticked a polyester film of the thickness of 38$\mu$ by means of cold setting epoxy resin bonding agent to form a three layer photosensitive body.

To the said photosensitive body was applied +7 KV corona discharge, then simultaneously with the image exposure applied an AC corona electric charge, and further by exposing the whole surface uniformly formed an electrostatic latent image which was developed using the above mentioned liquid developer obtaining a good positive image. Placing a sheet of transfer paper on top of the said image +6 KV electric discharge was applied from the rear face and when the transfer paper was taken off most of the picture on the photosensitive body was transferred to the said transfer paper. The transferred picture was distinct with high density and fixed perfectly. When development was performed using a liquid developer II having composition of the above mentioned liquid developer but not containing the copolymer consisting of sodium methacryl sulphonate and octyl methacrylate, the developed picture was very bad with much fog and the density of picture was low.

Also, similarly, development was made using a liquid developer III prepared by using just the same amount of sodium clodecylbenzene sulphonate instead of the stearyl methacrylate-sodium p-styrene sulphonate copolymer in the above.

The data obtained in the above by comparing the picture density and fog density relative to the liquid developer prepared time and after allowing it to stand for one month is given below.

| | Developer prepared time | | After standing one month | |
|---|---|---|---|---|
| Liquid developer | Picture density | Fog density | Picture density | Fog density |
| Example 1 | 1.04 | 0.02 | 1.04 | 0.02 |
| Liquid developer –2 | 0.5 | 0.05 | 0.4 | 0.05 |
| Liquid developer –3 | 0.8 | 0.04 | 0.5 | 0.05 |

The above data shows that the liquid developer of the present invention provides high picture density, less fog and excellent conservation stability.

EXAMPLE 2

Example 1 was repeated using lauryl methacrylate instead of stearyl methacrylate and further using sodium methallylsulphonate instead of sodium P-styrene-sulphonate and there was obtained colorless tacky copolymer.

Next, the mixture of 50 g of carbon black, 200 g of curomane resin, 100 g of cyclized rubber and 800 g of Isopar-H ((trademark of a product of Esso Co.) was dispersed in a sand mill, and 20 g of the resultant dispersion liquid and 1 g of the above mentioned lauryl methacrylate-methallyl sodium sulphonate copolymer were dispersed sufficiently in 800 g of Isopar-H to produce a liquid developer.

On the other hand, a mixture of 100 g of microcrystal zinc oxide, 20 g of styrene butadiene copolymer 50% toluene solution, 40 g of n-butyl methacrylate 50% toluene solution, 120 g of toluene, and 4 ml of Rose Bengale 1% methanol solution was dispersed for 6 hours in a sand mill, then it was coated on the paper which had been subjected to undercoating treatment and dried up so that the thickness of dried coating are became 20$\mu$ to obtain electrophotographic photosensitive paper. To the said photosensitive paper was applied –6 KV corona electric charge, then an enlarged image was projected from a microfilm of a negative to form an electrostatic latent image, and by soaking it in the above mentioned liquid developer a black positive image was obtained. Picture density was high and showed excellent fixability. In the case wherein the copolymer consisting of lauryl methacrylate and sodium methallyl sulphonate was not contained in the above mentioned liquid developer, the developed picture had very low picture density with much fog and the picture had a touch of solarization.

EXAMPLE 3

A mixture of 50 g of copper phthalocyamine blue, 200 g of cumarone resin, 100 g of cyclized rubber, 25 g of low molecular polyethylene, and 800 g of Isopar-H (trademark of a product of Esso Co.) was kneaded for 2 hours in a sand mill, and 20 g of the resultant dispersed material and 1 g of the copolymer of stearyl methacrylate and sodium P-styrene sulphonate used in Example 1 were dispersed in 800 g of Isopar-H to obtain a liquid developer.

On the other hand, melts consisting of high purity amorphous selenium and powder tellurium in the ratio of 9 : 1 was evaporated up to 50$\mu$ in thickness on a nickel plated brass plate to obtain a photosensitive plate. To the photosensitive plate was applied plus 6 KV corona electric charge and image exposure was made by means of a film having positive image so as to form an electrostatic latent image and then was developed using the above mentioned liquid developer, and when transferred to a transfer paper a clean positive picture was obtained and fixability was also perfect.

Picture density of said picture was 1.2 and fog density was 0.01.

The picture density and fog density of the reproduced body obtained in the same manner using a liquid developer which did not contain the copolymer were 0.45 and 0.05, respectively.

EXAMPLES 4 –15

Liquid developers were prepared in the same manner as in Example 1 by forming copolymers by means of the combination of monomers as shown in the table mentioned below and transcription was made. Almost the same results as Example 1 were obtained.

| Example | Monomer of general formula (1) | Monomer of general formula (2) | Mol ratio (1) : (2) | Added quantity of copolymer (g/l) | Picture density |
|---|---|---|---|---|---|
| 4 | 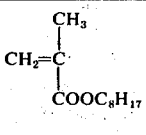 | 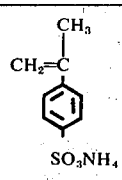 | 2 : 1 | 2 g | 0.9 |

-continued

| Example | Monomer of general formula (1) | Monomer of general formula (2) | Mol ratio (1) : (2) | Added quantity of copolymer (g/l) | Picture density |
|---|---|---|---|---|---|
| 5 | $CH_2{=}C(H)COOC_{17}H_{35}$ | $CH_2{=}C(CH_3)CH_2SO_3$ Ca $CH_2SO_3$ $CH_2{=}C(CH_3)$ | 1.5 : 1 | 0.8 g | 1.1 |
| 6 | $CH_2{=}C(H)C_8H_{17}$ | $CH_2{=}C(CH_3)CH_2SO_3K$ | 2 : 1 | 0.8 g | 1.05 |
| 7 | $CH_2{=}C(CH_3)C_{12}H_{25}$ | $CH_2{=}C(H)$ – $C_6H_4$ – $SO_3Na$ | 1.5 : 1 | 0.8 g | 1.0 |
| 8 | $CH_2{=}C(H)C_{17}H_{35}$ | $CH_2{=}C(CH_3)CH_2SO_3NH_4$ | 1.5 : 1 | 2 g | 0.85 |
| 9 | $CH_2{=}C(CH_3)OC_8H_{17}$ | $CH_2{=}C(H)CH_2SO_3Na$ | 2 : 1 | 0.8 g | 1.15 |
| 10 | $CH_2{=}C(H)OC_{12}H_{25}$ | $CH_2{=}C(CH_3)$ – $C_6H_4$ – $SO_3Na$ | 1.5 : 1 | 0.8 g | 1.04 |
| 11 | $CH_2{=}C(H)OC_{17}H_{35}$ | $CH_2{=}C(H)SO_3Na$ | 1.5 : 1 | 0.8 g | 1.0 |
| 12 | $CH_2{=}C(CH_3)COOC_{17}H_{35}$ | $CH_2{=}C(H)SO_3$ Ba $CH_2{=}C(H)SO_3$ | 1.5 : 1 | 0.8 g | 1.12 |
| 13 | $CH_3{=}C(H)COOC_8H_{17}$ | $CH_2{=}C(H)$ – $C_6H_4$ – $SO_3$ Mg $CH_2{=}C(H)$ – $C_6H_4$ – $SO_2$ | 2 : 1 | 0.8 g | 1.2 |
| 14 | $CH_3{=}C(CH_3)COOC_{12}H_{25}$ | $CH_2{=}C(CH_3)$ – $C_6H_4$ – $SO_3$ Sr $CH_2{=}C(CH_3)$ – $C_6H_4$ – $SO_3$ | 1.5 : 1 | 0.8 g | 1.0 |
| 15 | $CH_2{=}C(CH_3)C_{17}H_{35}$ | $CH_2{=}C(H)$ – $C_6H_4$ – $SO_3K$ | 1.5 : 1 | 0.8 g | 1.2 |

EXAMPLE 16

300 ml of dioxane, 2 g of stearyl methacrylate, 28 g of diethyl aminoethyl methacrylate, 2.5 g of 2′,2-azobis (isobutyronitrile) were poured into a 4-neck 500 ml flask. After sufficiently replacing the air in the flask with nitrogen gas, and while heating up to 40° – 50°C, solution of 18 g of sodium P-styrene sulphonate in 50 ml of water was dropped. After the dropping, the liquid temperature was raised up to 70° – 80°C and then after stirring for approximately 7 hours it was allowed to stand to cool down.

Concentration of the reaction liquid was made under reduced pressure and performed reprecipitation refining twice using 20% hydrous methanol and when the precipitates were dried up, light brown material was obtained. As a result of infrared absorption spectrum analysis of said material, it was confirmed that the material was a copolymer consisting of stearyl methacrylate, diethyl aminoethyl methacrylate and sodium P-styrene sulphonate.

Next, in order to make a liquid developer using the above mentioned copolymer, a mixture of 60 g of carbon black, 150 g of wax rubber, 100 g of cumarone resin, 800 g of Isopar-H (trademark of a product of ESSO Co.) was dispersed for 2 hours in a sand mill, and 20 g of the resultant dispersion material and 0.03 g of said copolymer were dispersed in 800 g of Isopar-H to obtain liquid developer.

Using said liquid developer transcription according to electrophotography was performed in a similar manner as described in Example 1.

Also in the above, for the sake of comparison a liquid developer was produced using the same amount of lecithin in place of the said copolymer and transcription was done in similar manner.

The data obtained in the above by comparing the picture density and fog density relative to the liquid developer prepared time and after allowing it to stand for one month is given below.

| Liquid developer | Prepared time | | After allowing to stand one month | |
|---|---|---|---|---|
| | Picture density | Fog density | Picture density | Fog density |
| Example 16 | 1.2 | 0.01 | 1.15 | 0.01 |
| Comparative developer | 1.0 | 0.02 | 0.9 | 0.03 |

EXAMPLE 17

A copolymer was prepared as in the case of Example 16 by using 38 g of stearyl methacrylate, 17.3 g of diethyl aminoethyl methacrylate and 14 g of sodium methallyl sulphonate.

Next, a mixture of 50 g of carbon black, 200 g of cumarone resin, 100 g of cyclized rubber, 800 g of Isopar-H (trademark of a product of Esso Co.) was dispersed for 2 hours in a sand mill, and then 20 g of the resultant dispersion material and 0.5 g of the above mentioned copolymer were sufficiently mixed and dispersed in 800 g of Isopar-H to obtain a liquid developer.

On the other hand, a melts consisting of high purity amorphous selenium and pulverulent tellurium in the ratio 9:1 was evaporated on a nickel plated brass plate up to 50$\mu$ in thickness to prepare a photosensitive plate. To the said photosensitive plate was applied plus 6 KV corona electric charge, and by means of film having a positive image, the image was exposed to form an electrostatic latent image which was developed using the said liquid developer, and when transferred onto a transfer paper, a clear positive picture was obtained.

The picture density of this picture was 1.2 and fog density was 0.01.

EXAMPLE 18

A polymer was synthesized in a similar manner as in the case of Example 16 using lauryl methacrylate, dimethyl aminoethyl methacrylate and sodium methallyl sulphonate.

Next, a mixture of 50 g of copper phthalocyamine blue, 200 g of cumarone resin, 100 g of cyclized rubber, 25 g of low molecular polyethylene, and 800 g of Isopar-H (trademark of a product of Esso Co.) was dispersed for 2 hours in a sand mill, and then 20 g of the resultant dispersion material and 0.08 g of the above mentioned reaction product were dispersed in 800 g of Isopar-H to obtain a liquid developer.

On the other hand, a mixture of 100 g of microcrystal zinc oxide, 200 g of styrene-butadiene copolymer 50% toluene solution, 40 g of n-butyl methacrylate 50% toluene solution, 120 g of toluene, and 4 ml of Rose Bengale 1% methanol solution was dispersed for 6 hours in a ball mill, and then it was coated on a paper which had underwent undercoating treatment and dried up so that the thickness of the dried up coating became 20$\mu$ to produce a photosensitive paper for electrophotography. To the said photosensitive paper was applied −6 KV corona electric charge, then an enlarged image was projected from a negative microfilm to form an electrostatic latent image which was soaked in the above mentioned liquid developer obtaining a clear black positive picture. Picture density of it was 1.0 and fog density was 0.01. Also, for the purpose of comparison a liquid developer which did not contain the above mentioned copolymer was prepared and development was made in the similar manner only to obtain a picture having low picture density and much fog.

EXAMPLE 19

Copolymers were produced by combination of the monomer listed in the table mentioned below in the similar manner as described in example 16, and then preparing liquid developers performed transcription. As a result almost the same effects as in the case of Example 16 were obtained.

| Example | Monomer of general formula (1) | Monomer of general formula (2) | Monomer of general formula (3) | Mol ratio (1):(2):(3) | Added quantity (g/l) | Picture density |
|---|---|---|---|---|---|---|
| 19 | 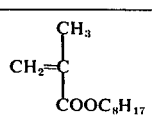 | 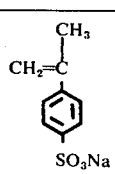 | 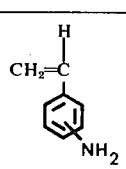 | 2:1:1 | 0.03 g | 1.1 |

-continued

| Ex.-ample | Monomer of general formula (1) | Monomer of general formula (2) | Monomer of general formula (3) | Mol ratio (1):(2):(3) | Added quan-tity (g/l) | Picture density |
|---|---|---|---|---|---|---|
| 20 | $CH_2{=}C(H)COOC_{17}H_{35}$ | $CH_2{=}C(CH_3)CH_2SO_3NH_4$ | $CH_2{=}C(CH_3)COO(CH_2)-N(C_2H_5)_2$ | 1.5:1:1 | 0.5 g | 1.0 |
| 21 | $CH_2{=}C(H)C_8H_{17}$ | $CH_2{=}C(H)CH_2SO_3Na$ | $CH_2{=}C(H)$ 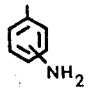 | 2:1:1 | 0.05 g | 1.1 |
| 22 | $CH_2{=}C(H)C_{17}H_{35}$ | $CH_2{=}C(CH_2)$ 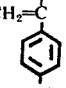 | $CH_2{=}C(H)(CH_2)_4N(CH_3)_2$ | 1.5:1:1 | 0.03 g | 1.15 |
| 23 | $CH_2{=}C(CH_3)C_{12}H_{25}$ | $CH_2{=}C(H)SO_3Na$ | $CH_2{=}C(H)$  | 1.5:1:1 | 0.05 g | 1.05 |
| 24 | $CH_2{=}C(CH_3)OC_8H_{17}$ | $CH_2{=}C(H)CH_2SO_3Ca$ 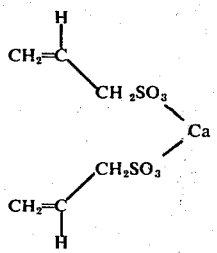 | $CH_2{=}C(CH_3)$  $(CH_2)_2N(C_2H_5)(CH_3)$ | 2:1:1 | 0.05 g | 1.15 |
| 25 | $CH_2{=}C(H)OC_{12}H_{25}$ | $CH_2{=}C(CH_3)CH_2SO_3K$ | $CH_2{=}C(CH_3)COOCH_2N(C_4H_9)_2$ | 1.5:1:1 | 0.05 g | 1.2 |
| 26 | $CH_2{=}C(H)OC_{17}H_{35}$ | $CH_2{=}C(H)SO_3Mg$ 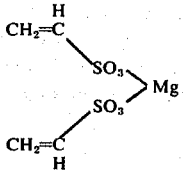 | $CH_2{=}C(H)COO(CH_2)_2N(CH_3)H$ | 1.5:1:1 | 0.05 g | 1.1 |
| 27 | $CH_2{=}C(CH_3)COOC_{12}H_{25}$ | $CH_2{=}C(H)$ 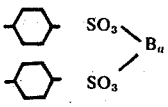 | $CH_2{=}C(CH_3)CH_2N(C_2H_5)_2$ | 1.5:1:1 | 0.03 g | 1.2 |
| 28 | $CH_2{=}C(H)COOC_8H_{17}$ | $CH_2{=}C(H)CH_2C(CH_3)$ 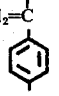 $SO_3Na$ | $CH_2{=}C(CH_3)COOCH_2N(CH_3)_2$ | 2:1:1 | 0.03 g | 1.12 |
| 29 | $CH_2{=}C(CH_3)OC_{12}H_{25}$ | $CH_2{=}C(CH_3)SO_3NH_4$ | $CH_2{=}C(CH_3)COO(CH_2)_4N(CH_3)(C_2H_5)$ | 1.5:1:1 | 0.5 g | 1.0 |
| 30 | $CH_2{=}C(H)C_8H_{17}$ | $CH_2{=}C(H)SO_3K$ | $CH_2{=}C(H)CH_2N(CH_3)(C_4H_9)$ | 2:1:1 | 0.05 g | 1.1 |

I claim:

1. A liquid developer for electrophotography comprising toner particles dispersed in a highly insulating carrier liquid having therein an addition polymer produced from at least one member selected from the monomers of the formula (1) and at least one member selected from the monomers of the formula (2):

General formula (1)

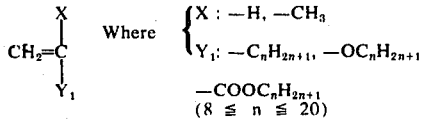

General formula (2)

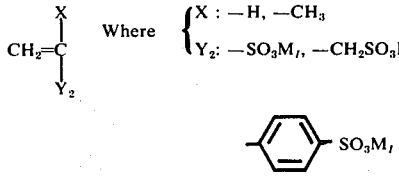

($M_l$ is alkali metal or $-NH_4$)

Or

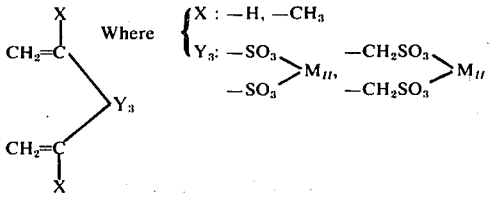

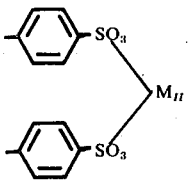

($M_{ll}$ is alkaline earth metal).

2. A liquid developer for electrophotography according to claim 1 in which the addition polymer is dissolved in the carrier solution in the range of 0.1 to 10 g. per one litre of the carrier liquid.

3. A liquid developer for electrophotography according to claim 1 in which the monomer of the general formula (2) is as shown below:

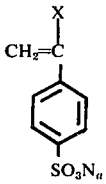

(X : —H, —$CH_3$).

4. A liquid developer for electrophotography according to claim 1 in which the monomer of the general formula (2) is as shown below:

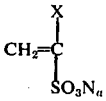

(X : —H, —$CH_3$).

5. A liquid developer for electrophotography according to claim 1 in which the monomer of the general formula (2) is as shown below:

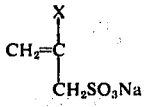

(X : —H, —$CH_3$).

6. A liquid developer for electrophotography comprising toner particles dispersed in a highly insulating carrier liquid having therein an addition polymer produced from at least one member selected from the monomers of the formula (1) and at least one member selected from the monomers of the formula (2):

General formula (1)

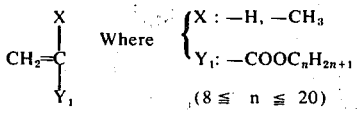

General formula (2)

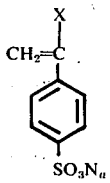

(X : —H, —$CH_3$).

7. A liquid developer for electrophotography comprising toner particles dispersed in a highly insulating carrier liquid having therein an addition polymer produced from at least one member selected from the monomers of the formula (1), at least one member selected from the monomers of the formula (2) and at least one member selected from the monomers of the formula (3):

General formula (1)

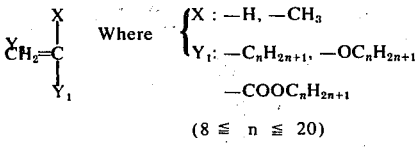

General formula (2)

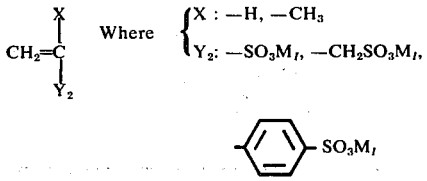

($M_l$ is alkali metal or $-NH_4$)

Or

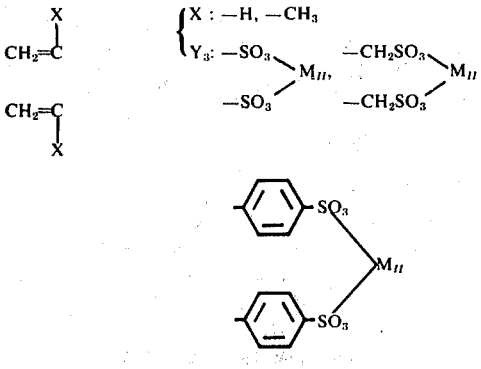

($M_{II}$ is alkaline earth metal)

General formula (3)

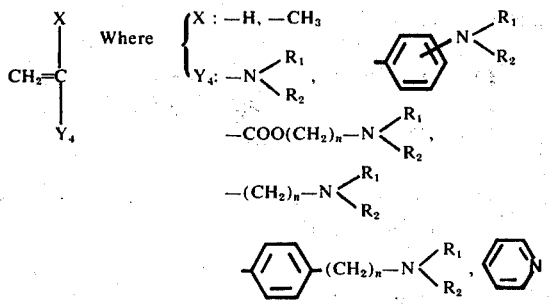

($1 \leqq n \leqq 4$, $R_1$, $R_2$ are H or $-C_m H_{2m+1}$ ($1 \leqq m \leqq 4$), and may be the same or different).

8. A liquid developer for electrophotography according to calim 7 wherein a addition polymer comprising the monomers of general formulae (1), (2) and (3) is dissolved within the range of 0.015 g – 1 g per 1 *l* of highly insulating carrier liquid.

9. A liquid developer for electrophotography according to claim 7 wherein the monomer of the general formula (2) is as shown below:

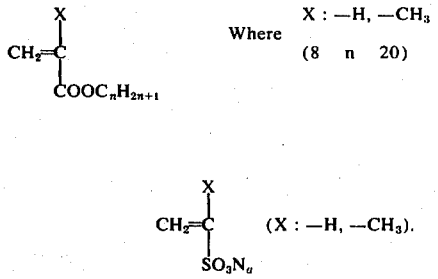

10. A liquid developer for electrophotography according to claim 7 wherein the monomer of the general formula (2) is as shown below:

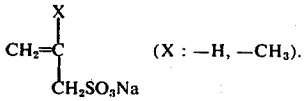

11. A liquid developer for electrophotography according to claim 7 wherein the monomer of the general formula (2) is as shown below:

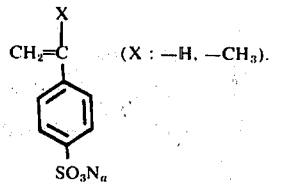

12. A liquid developer for electrophotography comprising toner particles dispersed in a highly insulating carrier liquid containing therein an addition polymer comprising at least one member selected from the monomers of the general formula (1), at least one member selected from the monomers of the general formula (2) and at least one member selected from the monomers of the general formula (3):

General formula (1)

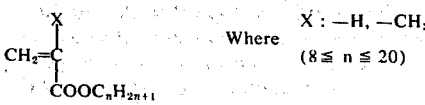

General formula (2)

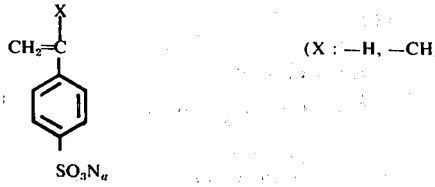

General formula (3)

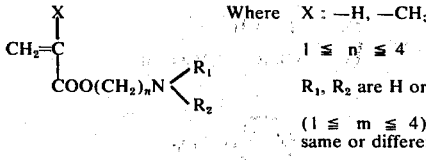

13. An electrophotographic developing method which comprises treating a surface with a latent image formed thereon with a liquid developer for electrophotography comprising toner particles dispersed in a carrier liquid having therein an addition polymer produced from at least one member selected from the monomers of the formula (1) and at least one member selected from the monomers of formula (2) to thereby make the latent image visible:

General formula (1)

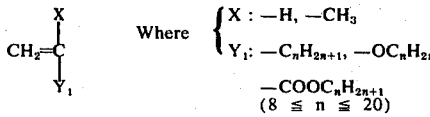

General formula (2)

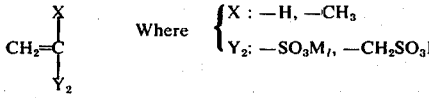

($M_I$ is alkali metal or $-NH_4$)

Or

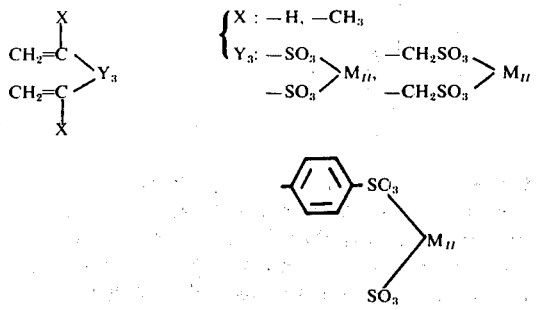

($M_{II}$ is alkaline earth metal).

14. An electrophotographic developing method which comprises treating a surface with a latent image formed thereon with a liquid developer for electrophotography comprising toner particles dispersed in a carrier liquid having therein an addition polymer produced from at least one member selected from the monomers of the formula (1), at least one member selected from the monomers of the formula (2) and at least one member selected from the monomers of the formula (3) to thereby make the latent image visible:

General formula (1)

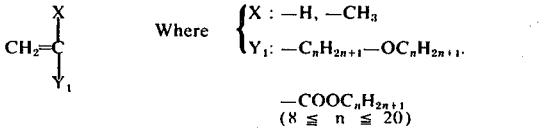

General formula (2)

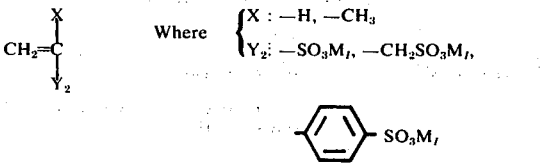

($M_I$ is alkali metal or $-NH_4$)

Or

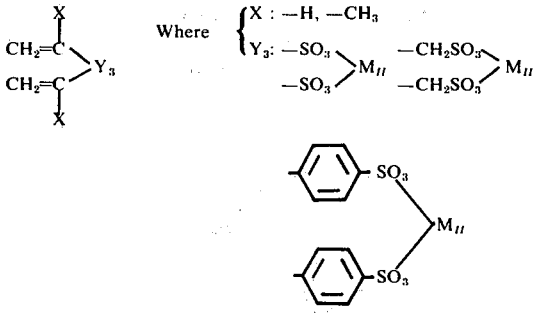

($M_{II}$ is alkaline earth metal).

General formula (3)

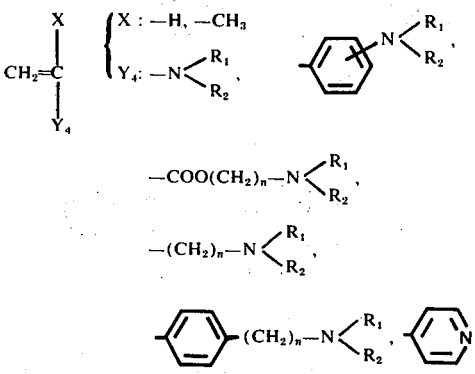

($1 \leqq n \leqq 4$, $R_1$, $R_2$ are H or $-C_mH_{2m+1}$ ($1 \leqq m \leqq 4$), and may the same or different)

* * * * *

UNITED STATES PATENT OFFICE
CERTIFICATE OF CORRECTION

Patent No. 3,969,238 Dated July 13, 1976

Inventor(s) TERUKUNI TSUNEDA

It is certified that error appears in the above-identified patent and that said Letters Patent are hereby corrected as shown below:

Col. 1, line 23, "alkyl" should be --alkyd--

Col. 17, claim 9, delete the formula and symbols in lines 45-48 as follows:

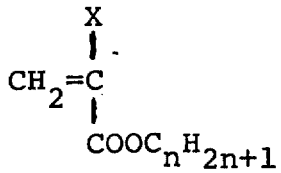

where X:-H, $-CH_3$ (8 n 20)

Col. 19, claim 13, lines 10-15,

" 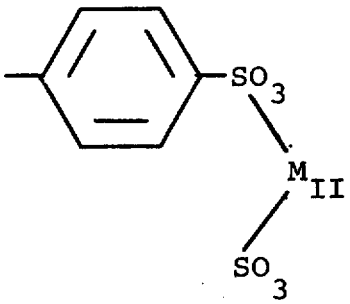 " should be 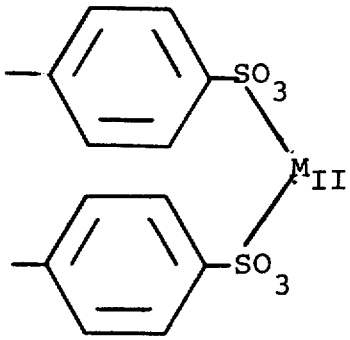

Signed and Sealed this

Thirtieth Day of November 1976

[SEAL]

*Attest:*

RUTH C. MASON
*Attesting Officer*

C. MARSHALL DANN
*Commissioner of Patents and Trademarks*